United States Patent [19]

Peterson et al.

[11] Patent Number: 4,989,655

[45] **Date of Patent: * Feb. 5, 1991**

[54] SIDE LOADING DEBARKING/DELIMBING APPARATUS AND METHOD

[75] Inventors: Arnold N. Peterson, Eugene; Larry A. Sprague, Dexter, both of Oreg.

[73] Assignee: Peterson Pacific Corp., Eugene, Oreg.

[ * ] Notice: The portion of the term of this patent subsequent to Feb. 27, 2007 has been disclaimed.

[21] Appl. No.: 462,086

[22] Filed: Jan. 8, 1990

Related U.S. Application Data

[63] Continuation of Ser. No. 238,905, Aug. 30, 1988, Pat. No. 4,903,744.

[51] Int. Cl.[5] ..... B27L 1/00

[52] U.S. Cl. ..... 144/341; 144/2 Z; 144/208 J; 144/343

[58] Field of Search ..... 144/2 Z, 208 R, 208 J, 144/341, 343

[56] References Cited

U.S. PATENT DOCUMENTS

| | | | |
|---|---|---|---|
| 4,544,008 | 10/1985 | Reini | 144/193 A |
| 4,787,431 | 11/1988 | Demlow | 144/208 J |
| 4,842,030 | 6/1989 | Meyer | 144/193 A |
| 4,903,744 | 2/1990 | Peterson et al. | 144/341 |

*Primary Examiner*—W. Donald Bray
*Attorney, Agent, or Firm*—Robert L. Harrington

[57] ABSTRACT

A debarking/delimbing apparatus and method wherein the apparatus is provided with a side loading entry into the debarking/delimbing flails. A pivotal ramp guides tree stems into and through the side entry. With the ramp in a lowered position a skidder-type stem hauler directs the tree stem bundle to be ramped upwardly into the side entry. With the ramp in a raised position a boom mounted grapple directs the tree stem bundle to be ramped downwardly into the side entry.

6 Claims, 2 Drawing Sheets

SIDE LOADING DEBARKING/DELIMBING APPARATUS AND METHOD

This is a continuation in part of U.S. Ser. No. 238,905, filed Aug. 30, 1088, now U.S. Pat. No. 4,903,744.

Field of Invention

This invention relates to an apparatus and method of debarking and/or delimbing tree stems or logs and particularly wherein the tree stems can be gripped at one end with a grapple, maneuvered sideways into a debarking/delimbing apparatus and pulled through the apparatus without releasing the stems.

Background of the Invention

This invention is an improvement to the debarking-/delimbing apparatus of the commonly assigned U.S. Pat. Nos. 4,719,950, 4,721,139 and 4,729,415.

Skidders are a commonly used tractor-like vehicle that is very maneuverable and has a rear mounted grapple. They are used to grab onto the butt ends of felled trees (tree stems) and drag the tree stems (often a bundle of small sized tree stems) from a location in the woods where the trees have been felled to a designated in-field base site. A bundle may consist of one or two to eight or ten tree stems ranging in size from about four inches to about twenty inches in diameter. The bundles of tree stems are hauled through the woods a short distance to the site which will often include a portable tree stem processing apparatus for partially processing the stems. This base site and the portable apparatus are moved from time to time as required by the progress of the logging operation.

A number of processing steps may take place with the portable stem processing apparatus. In one example, tree stems are debarked and/or delimbed by a debarking/delimbing apparatus. Such delimbing apparatus have an inlet including a guide roller for guiding the tree stems, butt-end first, into and through the apparatus wherein flails beat against the stems to tear off the limbs and/or remove the bark. The debarked and/or delimbed stems are then loaded onto trucks for hauling to a permanently-sited stem processing mill or in some cases, they are further processed in the field as by feeding the stems into a chipper to be used for pulp wood.

The present invention is concerned with the manner of debarking/delimbing the tree stems with a portable debarking/delimbing apparatus. Presently the skidder or skidder-like apparatus simply stacks the tree stems at a location convenient to the apparatus. The stems must be regrappled by a boom mounted grapple, inwardly from the butt end, and fed butt end first into the inlet of the debarking/delimbing apparatus. As the guide rollers and flails of the apparatus take control over the stems, the grapple releases that bundle and returns for a second bundle. The tree stems that emerge from the debarking-/delimbing apparatus must again be handled a third time, e.g. by a boom mounted grapple for loading onto trucks or feeding them into a chipping machine.

Brief Description of the Present Invention

It is an object of the present invention to reduce the handling of the tree stems. This is accomplished by providing in the preferred embodiment a debarking-/delimbing apparatus with a side opening including a guide ramp for guiding tree stems laterally into the flailing station of the apparatus.

The inlet and in-feed direction for feeding of the tree stems into the apparatus remains essentially the same. However, the side loading ramp of the present invention enables the commonly used skidder or boom mounted grapple to maneuver the tree stems so as to swing the butt ends of the tree stems through a side opening in the apparatus and then without releasing the stems, assist in pulling the remainder of the tree stems through the apparatus.

By using a skidder in certain of the tree stem processing operations, what was previously three separate handlings of the tree stems is reduced to one handling. Whereas certain other of the processing operations may not be adaptable to skidder handling throughout, three handlings may be reduced to two handlings with the skidder hauling the tree stems to the delimbing/debarking site, and then the boom mounted loader taking over the handling process. The tree stems are directed by the boom mounted grapple through the debarking/delimbing apparatus and then onto a truck or into a chipper.

The full scope and understanding of the invention will be more fully realized by reference to the following detailed description and drawings.

Detailed Description

Figure 2:
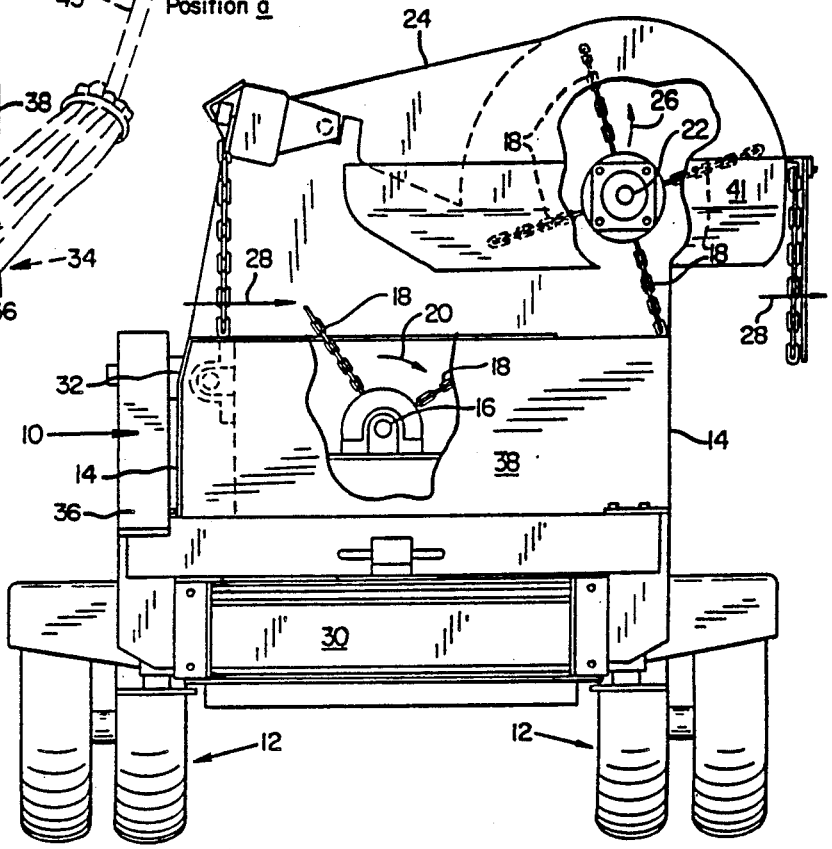
FIG. 2 is a side view of the debarking/delimbing apparatus of FIG. 1 (cross way to the direction of in-feed) with parts removed for illustration purposes.

Reference is first made to the FIG. 2 illustration of a flail-type debarking/delimbing apparatus in accordance with the invention. The components for infeeding of the stem bundle and for removing the bark and/or limbs is best illustrated in this view. They are common to known debarking/delimbing apparatus of the prior art. A more detailed description of these components will be found in the commonly assigned U.S. Pat. Nos. 4,719,950, 4,721,139 and 4,729,415.

The apparatus as illustrated is a portable unit and is accordingly mounted on wheels 12. The apparatus in general includes an enclosure or housing 14. A lower rotating shaft 16 carries a plurality of chain flails 18 that rotate as indicated by arrow 20. An upper rotating shaft 22 also carrying chain flails 18 is mounted on a portable or floating head 24 that pivots to move the shaft 22 up and down to adapt to different sizes of logs, as indicated by arrow 26.

Logs are fed into the apparatus between the upper and lower flails as generally indicated by directional arrows 28. The floating head 24 is adjusted by the log size to a desired height and the upper and lower flails cooperatively flail or beat the log with sufficient force to break off limbs and remove bark. In the illustrated embodiment, the limbs and bark fall to the bottom of the housing and into an ejection chute 30 where a ram pushes the materials away from the apparatus. In an alternate embodiment, the limbs and bark are simply ejected from the apparatus by the flails 18.

Figure 1:
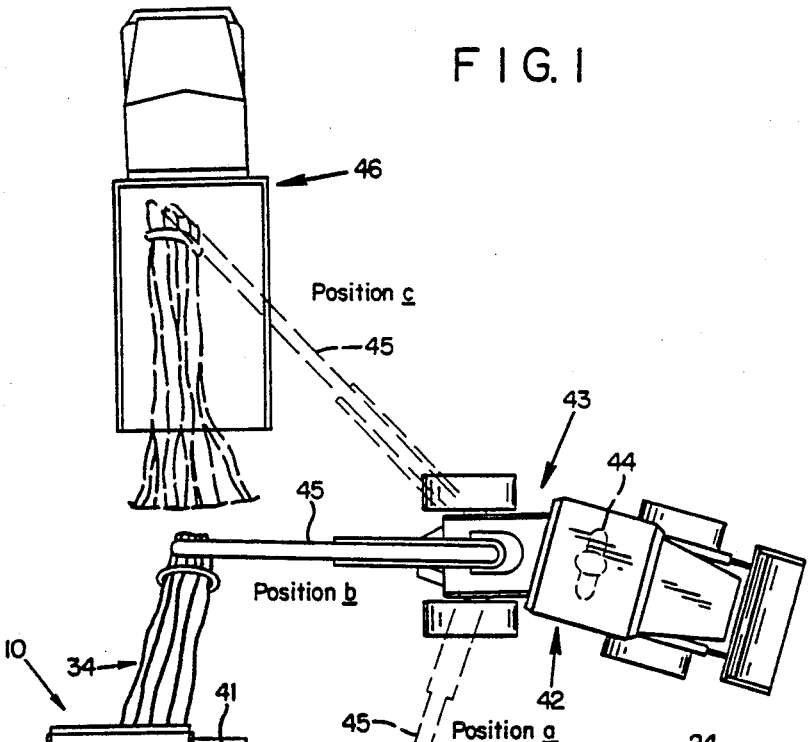
FIG. 1 is a schematic illustration of a boom mounted grapple maneuvering a bundle of tree stems through a side loading debarking/delimbing apparatus and onto the bed of a truck in accordance with the present invention.
Figure 3:
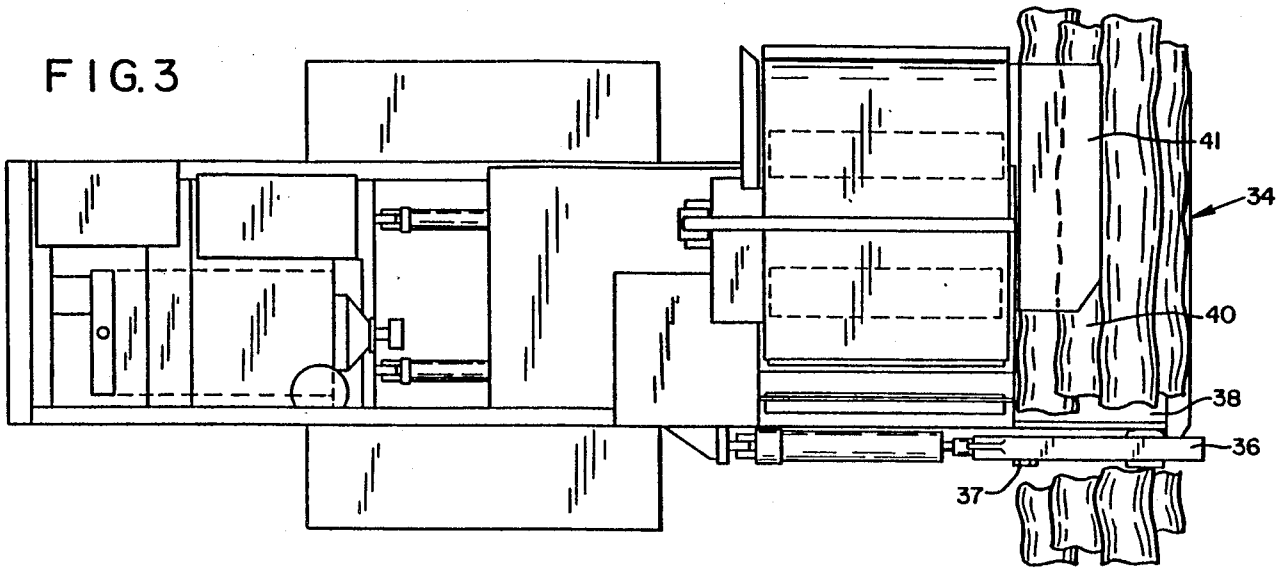
FIG. 3 is a top view of the apparatus of FIG. 1 illustrating a tree stem bundle being maneuvered into the flailing station thereof.
Figure 4:
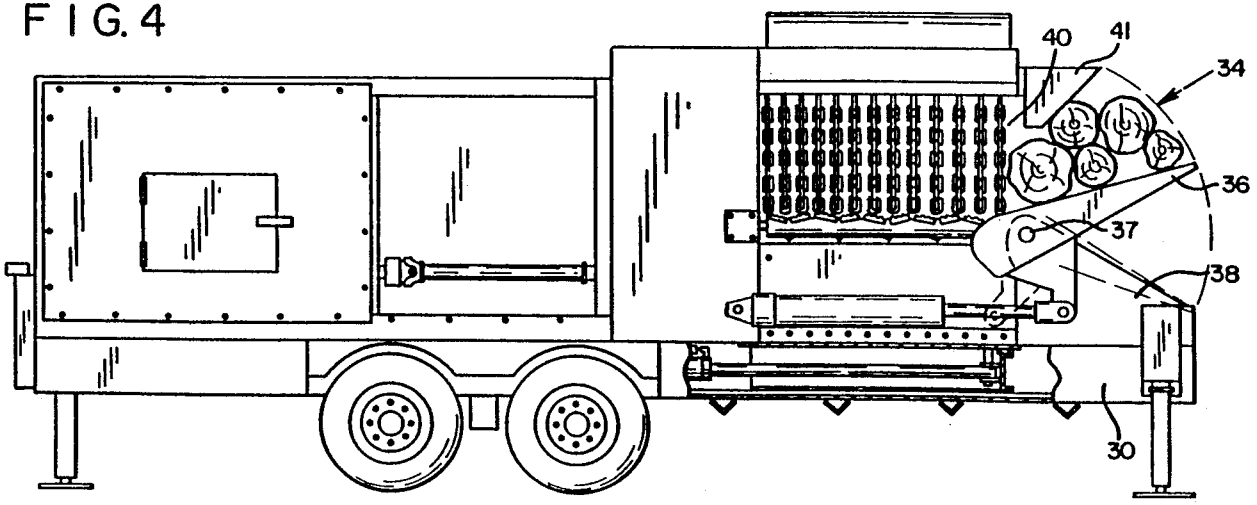
FIG. 4 is a side view of the apparatus of FIG. 1 also illustrating the bundle of tree stems being maneuvered into the flailing station.

Reference is now made to FIGS. 3 and 4 which illustrate the features of improvement over the apparatus of the prior patents. The side wall of housing 14 is provided with a slotted opening 40 to permit lateral sliding of a stem bundle 34 into the chain flails or flailing station. A pivotal ramp 36 is mounted by a pivot 37 to the side of a fixed ramp 38. In the position shown, ramp 36 is adapted for receiving a stem bundle 34 maneuvered by a boom mounted grapple (FIG. 1). When pivoted to its lowered position, ramp 36 cooperates with ramp 38 for receiving a stem bundle maneuvered by a skidder mounted grapple (not shown). An upper guide 41 cooperates with the ramp 36 or ramp 38 to guide the bundle 34 into the opening 40.

Operation

The process of loading the bundle 34 into the debarking/delimbing flails of the apparatus is illustrated in FIG. 1. A truck mounted boom 42 is provided with controls 43 to enable an operator 44 to manipulate the boom arm 45 and grapple 46. Tree stems are stacked, e.g. adjacent the inlet side of the debarking/delimbing apparatus. The operator maneuvers the boom and grapple to pick up a tree stem bundle 34 and draws the bundle across the corner of the apparatus as illustrated in FIG. 1, position a. The butt end of the bundle 34 is positioned between the pivotal ramp 36 and upper ramp 41 as indicated in FIG. 4. The bundle is then drawn forward and around the apparatus as illustrated at position b of FIG. 1. The bundle is then simply drawn through the apparatus and loaded onto a truck 46 as indicated by position c in FIG. 1.

The advantages of this invention will be very obvious to logging operators upon review of the disclosure herein. Numerous variations, modifications and changes will become apparent to those skilled in the art. Such changes are contemplated and encompassed by the claimed invention as defined in the claims appended hereto.

We claim:

1. An apparatus for debarking/delimbing tree stems comprising, a housing, debarking/delimbing members contained in the housing and defining a debarking/delimbing station, said housing having an inlet and an outlet for directing tree stems into and through the debarking/delimbing station and establishing thereby a stem feeding direction, said housing having a side opening crossway to the stem feeding direction to permit entry of a stem bundle, and guide members mounted to said housing and flared outwardly from the side opening to receive and direct tree stems being maneuvered laterally toward the side opening into and through the side opening and into the debarking/delimbing station.

2. An apparatus as defined in claim 1 wherein the guide members are upper and lower flared ramps projected from the side opening whereby tree stems of a grappled bundle of tree stems are directed along a ramp surface and into the side opening.

3. An apparatus as defined in claim 2 wherein the guide members include a lower ramp pivotally mounted to the housing for pivotal movement between an upperwardly directed ramping surface into the side opening to accommodate log stems maneuvered by a skidder grapple and a downwardly directed ramping surface to accommodate log stems maneuvered by a boom mounted grapple.

4. An apparatus as defined in claim 3 wherein the debarking/delimbing members are flexible flails that are rotated on shafts above and below the position of a log being directed through the debarking/delimbing stations, and including a driven guide roller in cooperation with the rotating flails for assisting the feeding of the stem bundle through the debarking/delimbing stations.

5. A process for debarking/delimbing tree stems comprising;

providing an apparatus including a debarking-/delimbing station having a defined direction of infeed and further including a side entry into the station and means for feeding tree stems laterally relative to the defined direction, through the side entry and into position for movement in the defined direction, utilizing a tree stem grapple for butt-end grappling and maneuvering of the butt end of the tree stem bundles initially along the infeed direction toward the debarking/delimbing station, then around to the side entry for ramping the tree stem bundle through the side entry and into the flailing station, and then redirecting the direction of butt-end movement for drawing the tree stem portions following the grappled butt ends thereof through the station along the defined direction of infeed.

6. A process as defined in claim 5 wherein the apparatus includes a pivotable ramp, and alternatively pivoting the ramp to a lowered position for ramping a tree stem bundle upwardly into the side entry the bundle being dragged on the ground by a skidder mounted loader, and pivoting the ramp to a raised position for ramping a tree stem bundle downwardly into the side entry the bundle being carried by a boom mounted grapple.

* * * * *